United States Patent [19]

McMenamin, IV

[11] 4,288,169

[45] Sep. 8, 1981

[54] FOUNTAIN TOOTH BRUSH WITH SNAP-ON CLOSURE

[76] Inventor: Hugh McMenamin, IV, 2532 Nevada St., Union City, Calif. 94587

[21] Appl. No.: 140,576

[22] Filed: Apr. 15, 1980

[51] Int. Cl.[3] ..... A46B 11/02

[52] U.S. Cl. ..... 401/175; 401/286

[58] Field of Search ..... 401/173–175, 401/278–280, 269, 277, 286–288

[56] References Cited

U.S. PATENT DOCUMENTS

| | | | |
|---|---|---|---|
| 965,309 | 7/1910 | MacDonald | 401/278 |
| 1,677,194 | 7/1928 | Mendoza | 401/286 |
| 2,046,161 | 6/1936 | Gulizia | 401/175 |
| 3,212,120 | 10/1965 | Gentile | 401/175 |
| 3,308,836 | 3/1967 | Joines | 401/175 |
| 3,409,381 | 11/1968 | Hoffman | 401/175 |
| 3,868,188 | 2/1975 | Velardi | 401/175 |
| 3,995,648 | 12/1976 | Kuryla | 401/287 |
| 4,128,349 | 12/1978 | Del Bon | 401/286 |
| 4,176,980 | 12/1979 | O'Neal | 401/287 |

FOREIGN PATENT DOCUMENTS

| | | | |
|---|---|---|---|
| 536637 | 4/1955 | Belgium | 401/175 |
| 300537 | 10/1954 | Switzerland | 401/175 |
| 434188 | 10/1967 | Switzerland | 401/175 |
| 1137 | of 1857 | United Kingdom | 401/175 |
| 22996 | of 1904 | United Kingdom | 401/175 |
| 1032673 | 6/1966 | United Kingdom | 401/175 |

*Primary Examiner*—Clyde I. Coughenour

*Attorney, Agent, or Firm*—Alvin E. Hendricson

[57] ABSTRACT

A fountain tooth brush having a hollow handle for holding toothpaste and a screw shaft with a piston movable when the screw shaft is rotated for forcing the toothpaste from the hollow handle through a passage and into the removable brush head for applying toothpaste to the bristles. The rear end of the hollow handle is closed by a snap-on cap and the interior of the cap has a non-circular recess for receiving the adjacent non-circular end of the screw shaft so that a rotation of the cap will rotate the screw shaft. The brush head has a threaded neck removably receivable in the interiorly threaded bore of the hollow handle at a concave handle surface and the neck has diametrically opposed projections against which the forward end of the screw shaft contacts to prevent any forward movement of the shaft when disengaged from the cap.

1 Claim, 6 Drawing Figures

FOUNTAIN TOOTH BRUSH WITH SNAP-ON CLOSURE

BACKGROUND OF INVENTION

Dispensing toothbrushes or fountain tooth brushes have many applications and advantages and have long been known, at least in the patent art. The present invention is an improvement upon the fountain tooth brush of U.S. Pat. No. 2,699,889 to Johnson. Despite the undoubted utility of fountain tooth brushes such devices have not experienced widespread use. One of the difficulties of these devices is the problem of manufacture and assembly in order to prevent inadvertant disassembly during use while yet minimizing the cost of manufacture.

An all plastic injection molded device would be advantageous from the cost standpoint and the present invention provides such a device.

SUMMARY OF INVENTION

An object of the invention is to provide a fountain tooth brush of improved construction that is readily filled with toothpaste from tubes and is adapted to dispense toothpaste. All parts may be formed of plastic. The hollow handle is closed at its rear end by a snap-on cap and I provide novel means for operatively connecting the hollow cap to the screw shaft so that a rotation of the cap will rotate the shaft and advance a piston for forcing toothpaste from the interior of the handle onto the bristles.

The forward end of the screw shaft is axially aligned in the hollow handle and is rotatably supported by a spider mounted within the handle. The threaded neck of the removable brush head is receivable in a threaded outlet bore in the concave front of the handle for permitting the toothpaste to be forced from the handle into the neck and on to the bristles. The end of the neck has one or more projections against which the disc-shaped head at the forward end of the screw shaft bears to prevent any forward movement of the shaft in the hollow handle when the shaft is disconnected from the cap.

DESCRIPTION OF DRAWINGS

The present invention is illustrated as to a single preferred embodiment in the accompanying drawings, wherein.

DESCRIPTION OF PREFERRED EMBODIMENT

Figures 1, 2, 3, 4, 5, 6:
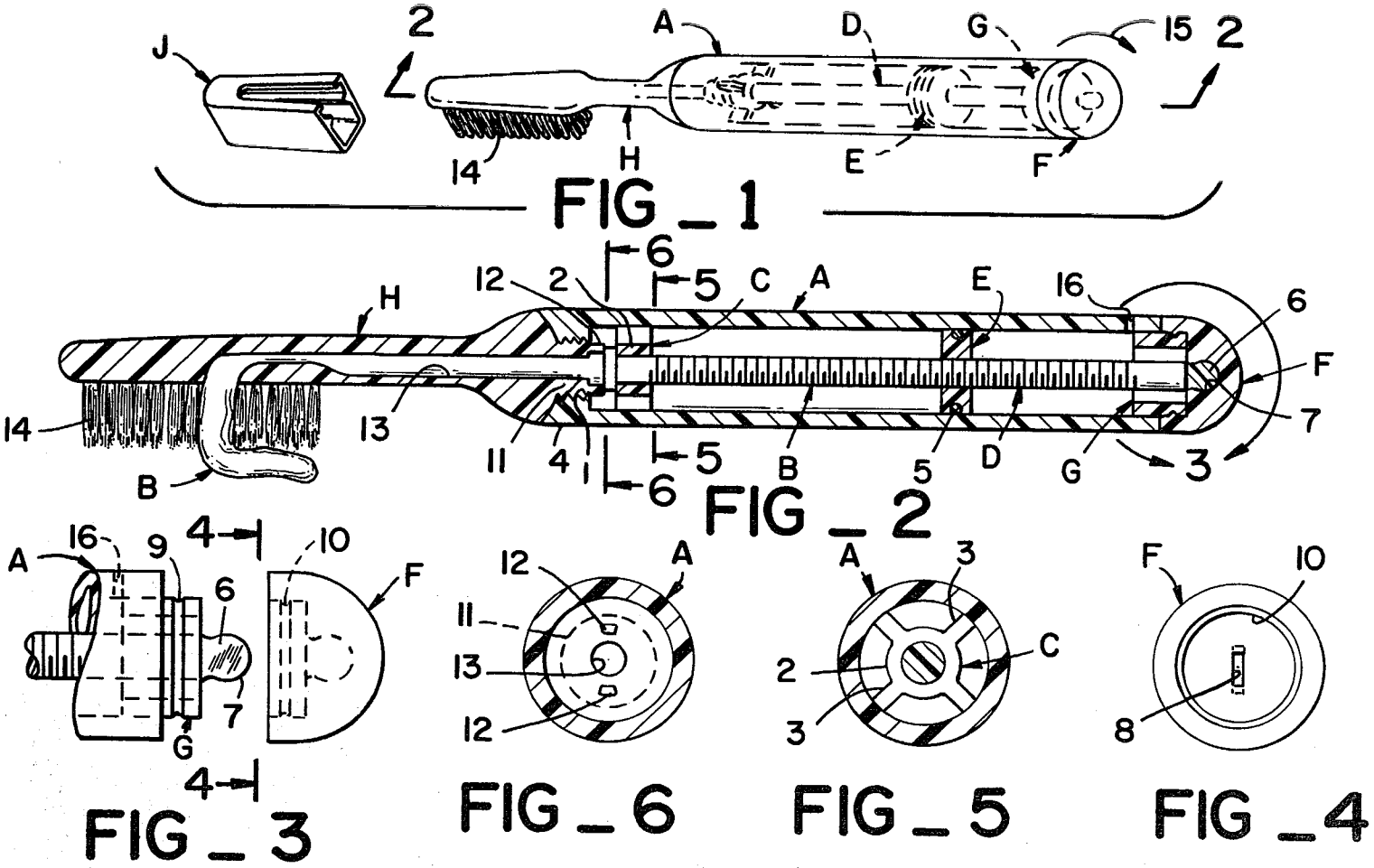
FIG. 1 is a perspective view of the fountain tooth brush with the sheath-like bristle cover shown removed from the brush head.
FIG. 2 is a longitudinal section through the fountain tooth brush and it is taken in a central longitudinal plane 2—2 of FIG. 1.
FIG. 3 is an enlargement of the circled portion 3 in FIG. 2, showing the snap-on cap in elevation and removed from the adjacent end of the hollow handle which is also shown in elevation. The non-circular end of the screw shaft is shown extending beyond the end of the handle.
FIG. 4 is an inner end view of the snap-on cap when looking in the direction of the arrows 4—4 of FIG. 3.
FIG. 5 is a transverse enlarged section taken in the plane 5—5 of FIG. 2 and shows the spider which axially supports the forward end of the screw shaft in the hollow handle.
FIG. 6 is another transverse enlarged section taken in the plane 6—6 of FIG. 2 and illustrates the diametrically opposed projections on the inner end of the brush head neck against which the disc-shaped head at the forward end of the screw shaft bears to prevent any forward movement of the screw shaft in the hollow handle when the rear end of the screw shaft is disconnected from the snap-on cap.

In carrying out my invention I provide a hollow tooth brush handle in the form of a cylindrical barrel A which is preferrably made of plastic. The hollow handle or barrel is adapted to hold toothpaste B, as indicated in FIG. 2 and has an internally threaded outlet opening 1 at a forward concave end of the handle. A spider C, see also FIG. 5, has a central aperture forming a bearing 2 for rotatably receiving the front unthreaded end of a screw shaft D. The spider 2 also has integral radial projections or wings 3 which extend outwardly in a radial direction and have their outer ends secured to the inner cylindrical surface of the hollow handle. In this way the spider axially aligns the shaft D with the longitudinal axis of the hollow handle A. Both the spider C and the screw shaft D are preferrably made from plastic. The front portion of the shaft D rotatably received in the spider bearing C is not threaded.

It will be noted from FIG. 2 that the inner end of the threaded shaft D has an integral disc-shaped head or flange 4 which is disposed between the spider C and the outlet opening 1 of the hollow handle A. A disc-shaped piston E preferrably made of plastic is disposed about the shaft D and has a central threaded bore for receiving the threaded shaft D. The piston slidably engages the handle interior bore and the periphery of the piston E may be formed with an annular groove and an "O" sealing ring 5 disposed in the groove to yieldingly contact the inner surface of the hollow handle A. Rotation of the shaft D moves the piston E longitudinally of the handle.

The enlarged view of the right hand end of the screw shaft D of FIG. 3 shows this shaft end 6 to be flattened on opposed faces and this end also is rounded at 7 in the plane of the flattened sides with a reduced neck portion. The end 6 of the screw shaft is designed to snap into a recess or depression 8 that is formed in the interior of a snap-on cap F which normally closes the open right hand end of the hollow handle A.

A sleeve G is formed integrally with or attached as by cement in the open end of the handle A and has a portion projecting beyond the end, the outer cylindrical surface of such sleeve being provided with an annular groove 9. The snap-on cap F has a cylindrical wall of limited flexibility defining a cylindrical recess with an annular interior or ridge rib 10, designed to be received in the groove 9 when the cap F is snapped into place on the sleeve G.

The flattened end 6 of the screw shaft D is adapted to be received in the complimental recess 8 in the interior end of the cap F, see FIG. 4, when the cap F is snapped into place, see also FIG. 2, so that a rotation of the cap with respect to the hollow handle A will turn the threaded shaft D to advance the piston E along the handle interior for forcing toothpaste B toward the outlet 1 of the handle. Preferrably the shaft D has a left-handed thread so that clockwise rotation of the cap F will advance the piston.

It is noted at this point that I provide a tooth brush head H that has a threaded neck 11 removably receivable in the outlet 1 of the handle with a convex shoulder about the neck 11 mating with the concave handle end. The end of the neck 11 has diametrically opposed axial projections 12 which extend into the handle with the head threaded in the handle and against which the disc-shaped head 4 of the screw shaft D abuts. This arrangement prevents the screw shaft from being moved forewardly of the hollow handle A when the cap F is snapped into place on the collar or sleeve G, and the rounded right hand end 6 of the shaft with its flattened sides is snapped into place in the similarly shaped recess 8 in the cap. The flattened sides of the shaft end 6 contact the adjacent flattened sides of the recess 8 to join the cap to the shaft so that rotation of the cap will rotate the shaft. The projections 12 on the threaded end of the head H hold the shaft D so that the snap-on assembly of elements is possible.

Referring again to FIG. 2, it will be noted that the brush head H has a toothpaste conveying passage 13 extending through the neck 11 to the base of the bristle portion 14. The toothpaste will be directly applied to the bristles and the tooth brush can be used in the usual manner. The projections 12 afford sufficient space between the flanged head 4 of the shaft D and the entrance to the passage 13 in the neck 11 to permit the flow of toothpaste into the passage and on to the bristles 14 when the cap F is rotated in the direction of the arcuate arrow in FIG. 1. After the tooth brush has been used, the excess toothpaste remaining on the bristles may be washed away. A bristle-protecting cover J may be provided for sliding over the bristles 14 to protect them. The cover J is shown in FIG. 1; however, it is to be appreciated that various types of heads and bristle arrangements may be employed with the present invention.

When it is desired to refill the interior of the hollow handle A with a new supply of toothpaste, the bristle head H may be removed from the handle and then the neck of a toothpaste tube, not shown, screwed into the opening 1 in the handle. In the event that the threads on a toothpaste tube do not fit the handle threads it is only necessary to press the tube end against the concave handle end about the handle opening 1 to provide a seal so that toothpaste may be squeezed into the handle with the piston retracted. The tube may be squeezed for forcing the toothpaste into the handle after the cap F has been rotated for retracting the piston E. A small bleed hole 16 may be provided through the handle A immediately adjacent the sleeve G for permitting the escape of air from the handle as the piston is retracted and for permitting the entrance of air as the piston is moved in the opposite direction.

It will be seen from the foregoing description of a preferred embodiment of the present invention that there is provided an improved fountain tooth brush which may be readily formed entirely of plastic. The snap-on handle end is particularly advantageous in minimizing cost of construction and inadvertant displacement of the end during use. The necessity of threaded engagement of elements for cap locking is herein precluded by a particular head end structure which then commends the invention to manufacture by injection molding.

Although the present invention has been described herein with respect to a single preferred embodiment it will be apparent to those skilled in the art that modifications and variations are possible within the spirit and scope of the present invention and thus it is not intended to limit the invention to the precise terms of description or details of illustration.

What is claimed is:

1. A fountain tooth brush comprising:

(a) a hollow barrel for holding toothpaste and having at a rear end thereof a fixed sleeve with an outer end projecting beyond the rear end of said barrel and being provided with an annular groove, the front end of said barrel having a threaded outlet opening;

(b) a screw shaft receivable in said barrel and a spider mounted in said barrel and having a bore for rotatably receiving an unthreaded portion of said screw shaft, said spider being spaced a short distance from said barrel outlet opening and said screw shaft having a flanged head contacting said spider on the side thereof adjacent the outlet opening of said barrel;

(c) a brush head with a threaded end removably receivable in said barrel outlet and having a toothpaste conveying passage leading from its threaded end to the bristle portion of said brush head, the inner end of said threaded end having spaced apart projections for extending into said barrel and contacting the adjacent end of said screw shaft head for spacing the flanged shaft end from the barrel outlet and preventing any axial movement of said screw shaft toward said threaded outlet of said barrel;

(d) a snap-on cap having a recess for receiving the exposed portion of said sleeve, the recess having a cylindrical wall of limited flexibility for rotatably receiving the outer cylindrical wall of said sleeve and having an annular rib adapted to be snapped into the annular groove in said sleeve;

(e) said shaft having a length to dispose the end of said screw shaft opposite to said head end projecting beyond the outer end of said sleeve being rounded with an indentation adjacent thereto and having flattened parallel side faces and a rounded end, said snap-on cap having said recess formed with an inner depression shaped similar to the screw shaft end which projects beyond said sleeve for operatively receiving this shaft end when said cap is snapped onto said sleeve so that rotation of said cap will rotate said screw shaft, the projections on the threaded end of said brush head contacting said screw shaft head for retaining said screw shaft against moving inwardly into said barrel when said cap is forced against said shaft end thus opposing the force required to snap the cap onto the adjacent end of said screw shaft and onto the sleeve; and (f) a piston slidably received in said barrel and having a threaded bore for receiving said screw shaft so that rotation of said cap moves said piston through said barrel.

* * * * *